United States Patent [19]

Pollock

[11] 4,181,068

[45] Jan. 1, 1980

[54] APPARATUS FOR PRODUCING PAPER TOWELS

[75] Inventor: Stephen F. Pollock, Palatka, Fla.

[73] Assignee: Hudson Pulp & Paper Corp., Darien, Conn.

[21] Appl. No.: 842,161

[22] Filed: Oct. 14, 1977

[51] Int. Cl.[2] ..... B31B 1/14

[52] U.S. Cl. ..... 93/1 A; 93/58 ST; 93/58.1

[58] Field of Search ..... 93/1 A, 58 ST, 58.1; 72/366

[56] References Cited

U.S. PATENT DOCUMENTS

| | | | |
|---|---|---|---|
| 3,187,539 | 6/1965 | Shultz | 72/366 X |
| 3,956,915 | 5/1976 | Saunders | 72/366 |

*Primary Examiner*—Leon Gilden

*Attorney, Agent, or Firm*—Harold L. Stults; William S. Frommer

[57] ABSTRACT

A roll of embossed paper towelling in which the embossing comprises lands and valleys between the lands wherein the lands are in rows extending at an acute angle to the longitudinal direction of the towelling. The acute angle of the rows of lands offsets each land with respect to the lands of the next adjacent turns or layers of the towel in the roll. That causes the layers to be held apart, and the desirable characteristics of the towels are preserved. There is also apparatus and a method for producing the embossed paper towelling. An embossing roll has a continuous spiral row of embossing elements or patterns which produce the embossing on the towelling. The spiral rows are at an angle of the order of five degrees from the longitudinal edges of the towels, i.e., the edges extending in the direction of the embossed sheet.

1 Claim, 4 Drawing Figures

FIG. 1
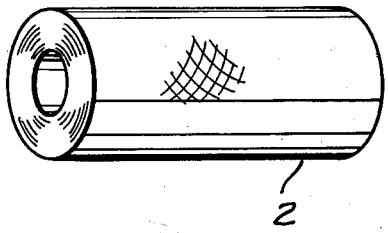
FIG. 2
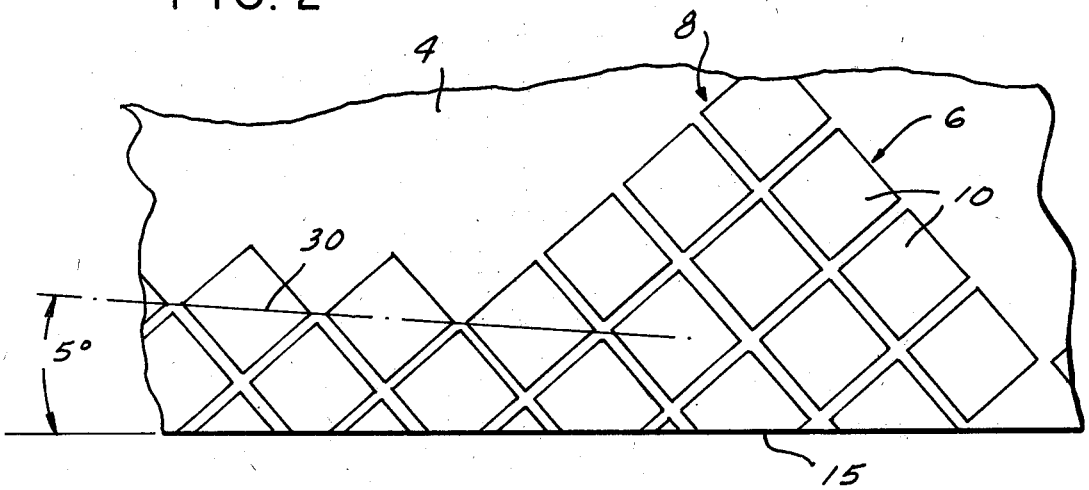
FIG. 4
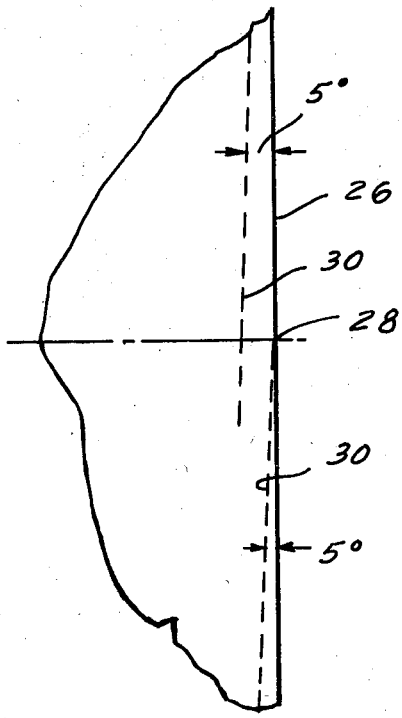
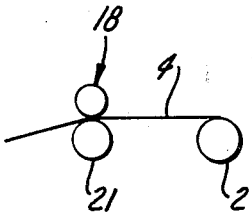
FIG. 5

APPARATUS FOR PRODUCING PAPER TOWELS

The production of some types of paper towels involves embossing a continuous sheet to form lands which are offset from each other by areas or valleys defining the lands. In order to preserve the desired structure and absorption characteristics in the paper towels, it is desirable to prevent the bulk characteristics of the towels from being deformed. The towelling is embossed by running a continuous sheet between steel mating male and female embossing rolls. U.S. Pat. No. 3,048,512 discloses a method for producing the embossing pattern on a set of embossing rolls, and for embossing sheet materials. In accordance with that disclosure, the female roll is produced from a smooth roll from an engraving tool. The roll is first coated with an acid-resistant coating. The coated roll and the cylindrical engraving tool are then mounted upon adjacent axes with the engraving tool overlying an end portion of the roll and with the tool and roll in contact with each other at their peripheries. The roll is then rotated, and the tool being rotated by peripheral contact with the roll produces the embossing pattern in the coating on the roll by removing the respective areas of the coating. That procedure is repeated on the adjacent portion of the embossing roll, and is further repeated until the entire roll bears the embossing design. The roll is then placed into an acid-etching solution and the exposed metal is etched away where the coating has been removed. That entire etching procedure is repeated to provide the proper depth of the embossing pattern in the roll. The mating roll is then produced by the same procedure using the female roll as the engraving roll.

It is an object of the present invention to provide improved paper towelling and rolls of paper towels produced therefrom. Another object is to provide improved systems and methods for producing embossing rolls. It is a further object to provide for the above with methods and apparatus which are superior to those of the prior art. These and other objects can be in part obvious and in part pointed out below.

In the drawings, in which an illustrative embodiment of the invention is shown:

FIG. 1 is a perspective view of a roll of paper towels;

FIG. 2 is an enlarged plan view of a small portion of one of the towels of FIG. 1;

FIG. 4 is a view of a portion of an embossing roll and the engraving tool.

Figure 3:
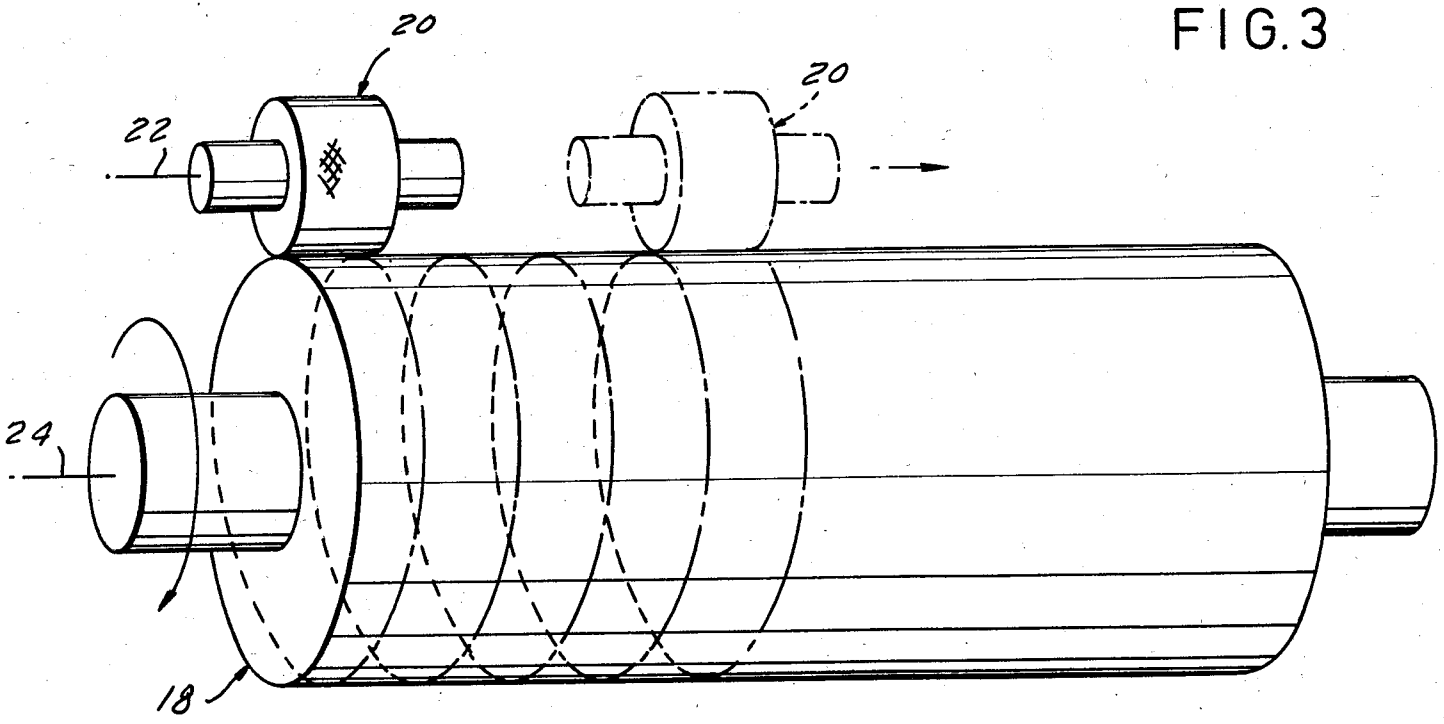
FIG. 3 is a somewhat schematic perspective view of an end portion of the female embossing roll and the engraving tool in operating relationship.

Referring to FIG. 1 of the drawings, roll 2 is a continuous strip or sheet of embossed paper towelling which is perforated in a known manner so that lengths constituting individual towels 4 can be torn from the strip. The embossing (see FIG. 2) is in the form of continuous rows 6 and 8 of lands 10 separated by valleys 12. Lands 10 are also in rows 11 which overlap somewhat and have center lines 14, designated 14*a*, 14*b*, etc. Lines 14 are at an angle of the order of five degrees from the side edges 15 of the towel.

The embossing pattern is relatively small, there being four to six lands 10 per inch along rows 6 and 8. With some of the prior embossed towels of this type, the lands and valleys tend to nest when the towels are wound into a roll, and that can impair the desirable bulk characteristics of the roll of towels. The fact that rows 11 are at an angle to the side edges of the towels causes the lands on adjacent layers in the roll to be out of alignment with each other and they cannot nest. Hence, (see FIG. 3) the lands in each row, which extend along a center line 11, are sufficiently offset from the rows above and below it to provide a bridging effect between the lands. It is thus seen that roll 2 has "high bulk" and the towels retain their desired characteristics.

The embossing of the towelling of roll 2 is performed in a known manner by passing the strip of paper between an embossing roll 18 (see FIG. 3) and a mating roll, not shown. The continuous embossing pattern on roll 18 and its mating roll is a continuous spiral from one edge of the cylindrical embossing surfaces to the other. In producing roll 18, an engraving tool 20 is mounted to rotate freely on its axis 22 which is parallel to axis 24 of roll 18. The procedure for producing embossing roll 18 and its mating roll is the same as that disclosed in U.S. Pat. No. 3,048,512 which has been discussed above. However, instead of producing the pattern step-by-step from one end of the roll to the other as discussed above, the engraving tool is moved axially while the tool and roll are rotated. That is, with tool 20 positioned at the left-hand end of roll 18 as shown in FIG. 3, the rotation of the roll has been started and tool 20 is being fed at a constant rate axially throughout the length of the roll. Tool 20 has four parallel circular rows of the embossing pattern and the simultaneous axial movement of the tool with the rotary movement of the roll and the tool causes the embossing pattern to be impressed upon the roll in a spiral path. In that sense, the operation is similar to producing a screw thread on a lathe. Referring to FIG. 4 of the drawings, the center line of the leading end of the spiral row of pattern elements on the tool first moves past the edge 26 formed by the end face of the embossing roll at point 28. That center line passes along the path represented by line 30 which is at an angle of five degrees from edge 26. Line 30 extends spirally around the roll and at the end of the first complete turn of the roll it is spaced from edge 26 a distance equal to the width of the embossing pattern.

As the rotation of the embossing roll and the tool and the axial movement of the tool continue, a spiral embossing pattern is produced on the entire cylindrical surface of the embossing roll. The pattern is formed in the acid-resistant coating in the manner discussed above. It has been pointed out that the embossing pattern extends for four complete spirals on the embossing tool. Hence, as each of the spiral rows beyond the first row on the tool moves onto the embossing roll, it mates with the embossing pattern produced during the first rotation of the roll. That insures that the complete pattern is produced with true fidelity throughout the surface of the roll. The roll is then etched as discussed above, and it is then again coated and subjected to the action of the embossing tool with the action being synchronized so that the embossing pattern is in exact alignment with the embossed pattern. The procedure is repeated until the complete pattern has been etched onto the roll, as discussed above. While it is understood that a single row of the pattern design can be used to produce a satisfactory impression, the use of a plurality of rows of the pattern provides assurance of completely satisfactory results. When roll 18 has been completed, it is used to produce the mating roll in the manner explained in U.S. Pat. No. 3,048,512. Hence, the mating roll is a mirror image of roll 18.

It is understood that modifications can be made in the illustrative embodiments of the invention within the scope of the claims. It is also understood that other embodiments of the invention may be used to produce other products.

I claim:

1. Apparatus for embossing paper towelling to produce lands and valleys therein, with the lands having a maximum dimension of the order of one-quarter of an inch, said apparatus comprising a male embossing roll having a continuous spiral row of identical embossing patterns, each pattern having lands and valleys with the lands having a maximum dimension of the order of one-quarter of an inch and with the direction of each spiral row being offset at an angle of approximately 5° with respect to the end face of said male embossing roll, a mating female embossing roll which forms a nip in an embossing zone, and means to pass a continuous strip of paper towelling through said nip between said male embossing roll and said mating female embossing roll, whereby each of the embossing patterns in said male and female embossing rolls forms one of said lands in the paper towelling such that said lands are arranged in parallel rows that are offset with respect to the edge of said paper towelling by approximately 5°, and whereby the paper towelling can be wound into individual rolls with the spiral patterns of the lands offsetting each land from those of the adjacent rows sufficiently to prevent nesting of the lands.

* * * * *